US005755371A

United States Patent [19]

Huang

[11] Patent Number: 5,755,371

[45] Date of Patent: May 26, 1998

[54] HANDY BUTTON ATTACHING APPARATUS

[76] Inventor: Dennis Huang, 5F, No. 10, Lane 9, Ningpo E. St., Taipei, Taiwan

[21] Appl. No.: 722,848

[22] Filed: Sep. 26, 1996

[51] Int. Cl.[6] ..... B25C 1/04

[52] U.S. Cl. ..... 227/71; 227/67

[58] Field of Search ..... 227/67, 71, 68

[56] References Cited

U.S. PATENT DOCUMENTS

| | | | |
|---|---|---|---|
| 2,069,878 | 2/1937 | Flood | 227/67 |
| 2,707,783 | 5/1955 | Sullivan | 227/71 |
| 3,815,798 | 6/1974 | Lavitch et al. | 227/67 |
| 3,875,648 | 4/1975 | Bone | 227/67 |
| 5,205,458 | 4/1993 | Kunreuther | 227/71 |
| 5,518,162 | 5/1996 | Deschenes et al. | 227/71 |

*Primary Examiner*—Scott A. Smith
*Attorney, Agent, or Firm*—Bacon & Thomas

[57] ABSTRACT

A button attaching apparatus adapted for attaching a button to a cloth, including a body having a handhold portion and a barrel, the barrel defining a longitudinal top-open chamber, a pair of needles fastened to the barrel at the front side and having a respective longitudinal guide groove, a push handle sliding in the longitudinal top-open chamber of the body on the outside, a pair of projector rods respectively connected to the push handle and moved by it to drive a wire nail along the longitudinal guide grooves of the needles into the cloth in securing the button to the cloth, and, a pair of springs adapted for imparting a backward pressure to the projector rods.

5 Claims, 3 Drawing Sheets

HANDY BUTTON ATTACHING APPARATUS

BACKGROUND OF THE INVENTION

The present invention relates to button attaching apparatus, and relates more particularly to a handy button attaching apparatus convenient for individual use to fasten a button to a cloth.

A variety of tools have been disclosed for attaching buttons to clothing. Exemplars are seen in U.S. Pat. No. 4,134,350, entitled "Combined button stitching and sewing machine"; U.S. Pat. No. 5,058,515, entitled "Button stitching apparatus"; U.S. Pat. No. 5,518,162, entitled "Fastener attaching tool". The fastener attaching tool of U.S. Pat. No. 5,518,162 comprises a body having a pair of projector rods, a pair of needles mounted on the body at the front side, an ejector mechanism, and an end cap adapted for driving the ejector mechanism. This fastener attaching tool is designed for individual use. This fastener attaching tool is complicated in structure, and inconvenient to operate. When in use, the body must be held in hand with fingers, and the end cap must be forced forwards with the palm or the thumb, so that the fastener can be driven out of the tool.

SUMMARY OF THE INVENTION

It is one object of the present invention to provide a handy button attaching apparatus which is simple in structure, and inexpensive to manufacture. It is another object of the present invention to provide a handy button attaching apparatus which is convenient for individual use. According to one aspect of the present invention, the button attaching apparatus comprises a body having a handhold portion and a barrel, the barrel defining a longitudinal top-open chamber, a pair of needles fastened to the barrel at the front side and having a respective longitudinal guide groove, a push handle sliding in the longitudinal top-open chamber of the body on the outside, a pair of projector rods respectively connected to the push handle and moved by it to drive a wire nail along the longitudinal guide grooves of the needles into the cloth in securing the button to the cloth, and, a pair of springs adapted for imparting a backward pressure to the projector rods. According to another aspect of the present invention, the wire nail comprises a flexible wire body, and legs at two opposite ends of the flexible wire body. The barrel of the body has a wire nail mounting slot through which the wire nail can be loaded into position with the legs mounted in the longitudinal guide grooves of the needles. The wire nail can be injection-molded from flexible plastic material. Alternatively, the wire body can be made from fiber, and the two legs can be molded from plastic on the opposite ends of the fiber wire body.

DETAILED DESCRIPTION OF THE PREFERRED EMBODIMENT

Figure 1:
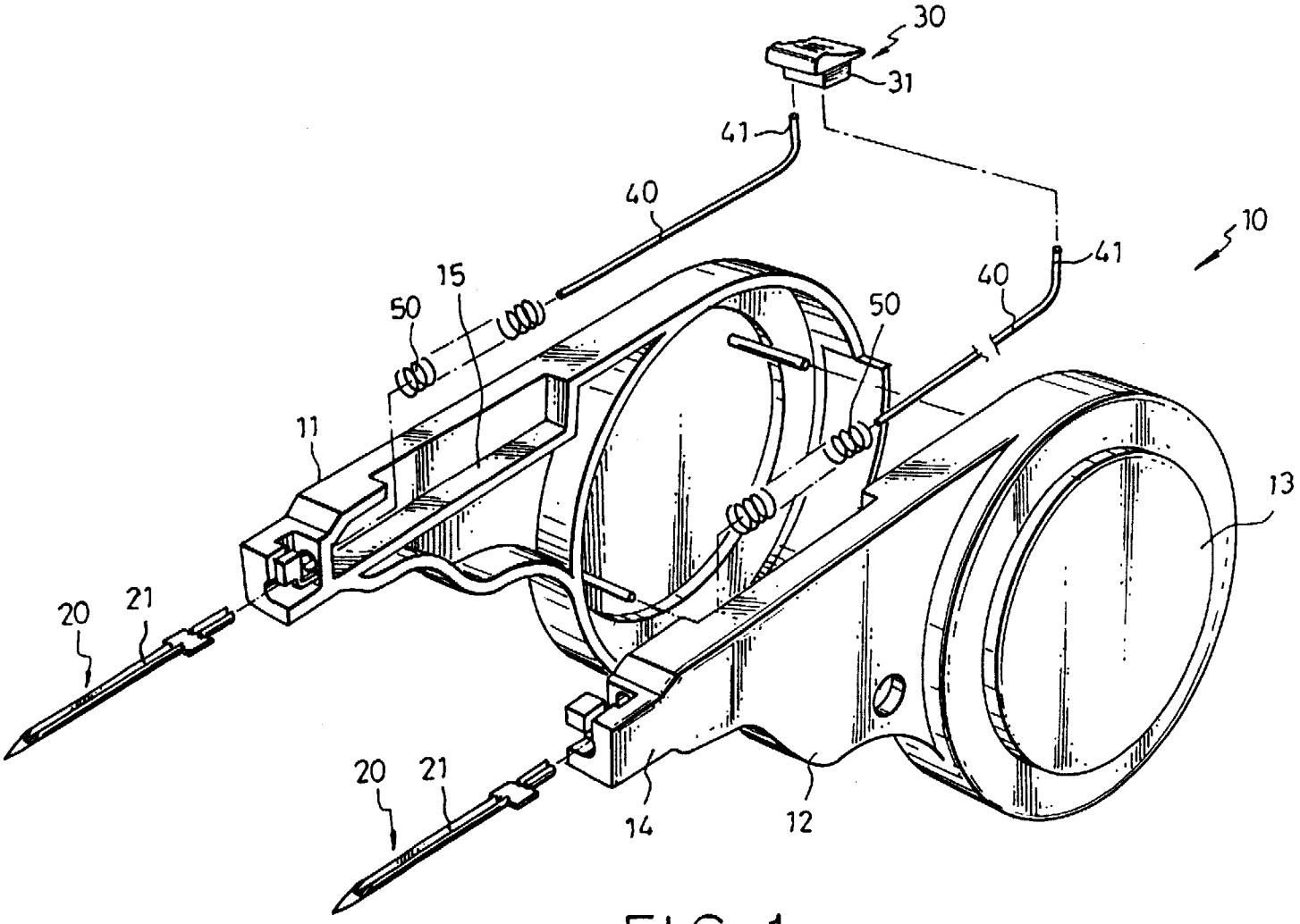
FIG. 1 is an exploded view of a handy button attaching apparatus according to the present invention.

Referring to FIG. 1, a handy button attaching apparatus in accordance with the present invention comprises a body 10, a pair of needles 20, a push handle 30, a pair of projector rods 40, and a pair of springs 50. The body 10 is comprised of left shell 11 and a right shell 12 fastened together, having a flat, circular handhold portion 13, and a barrel 14. The barrel 14 defines a longitudinal, top open chamber 15. The needles 20 are fastened to the barrel 14, having a respective longitudinal guide groove 21. The springs 50 are respectively mounted inside the longitudinal chamber 15 around the projector rods 40. The projector rods 40 are respectively moved along the longitudinal guide grooves 21 of the needles 20, having a respective hooked tail end 41 respectively fastened to the push handle 30. The push handle 30 has a sliding block 31 at the bottom adapted for sliding in the longitudinal top-open chamber 15 of the body 10 at the top.

Figure 2:
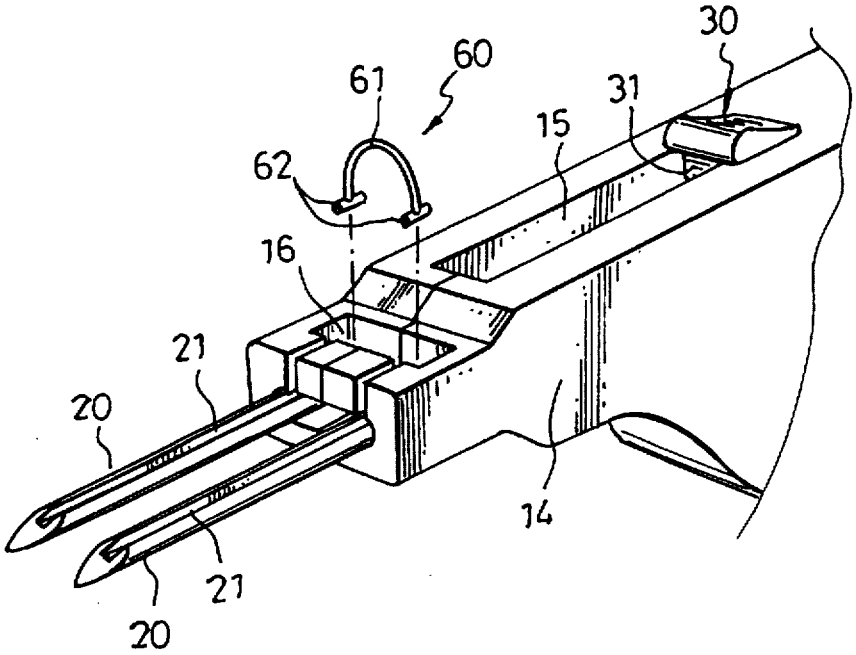
FIG. 2 is an elevational view of the front part of the handy button attaching apparatus shown in FIG. 1, showing the loading of a wire nail.

Referring to FIG. 2, the barrel 14 of the body 10 has a wire nail feeding slot 16 disposed at the top near the front side, and adapted for receiving a wire nail 60. The wire nail 60 comprises a wire body 61, and legs 62 at two opposite ends of the wire body 61. The wire body 61 is flexible, and can be bent into a substantially U-shaped configuration. The legs 62 of the wire nail 60 can be respectively mounted in the longitudinal guide grooves 21 of the needles 20. The wire nail feeding slot 16 preferably has a sloping guide surface adapted for guiding the legs 62 of the wire nail 60 into the longitudinal guide grooves 21 of the needles 20.

Figure 3:
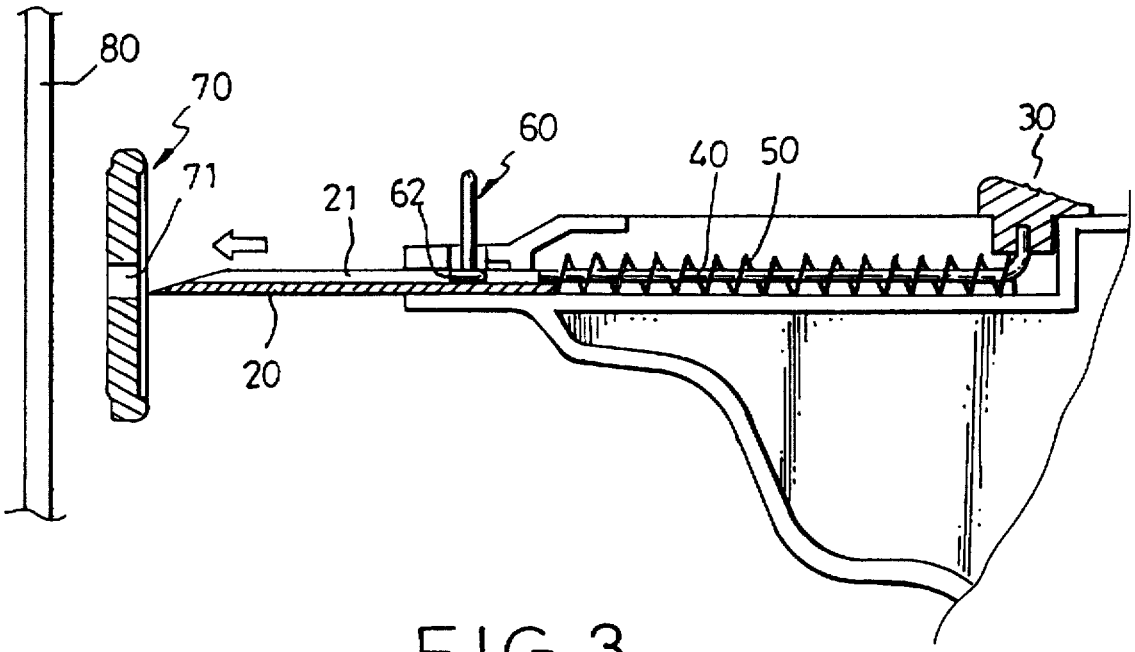
FIG. 3 is an applied view in section of the present invention, showing the wire nail loaded; and, FIG. 4 is similar to FIG. 3 but showing the needles inserted through the through holes of the button and the cloth, and the wire nail driven into position.
Figure 4:
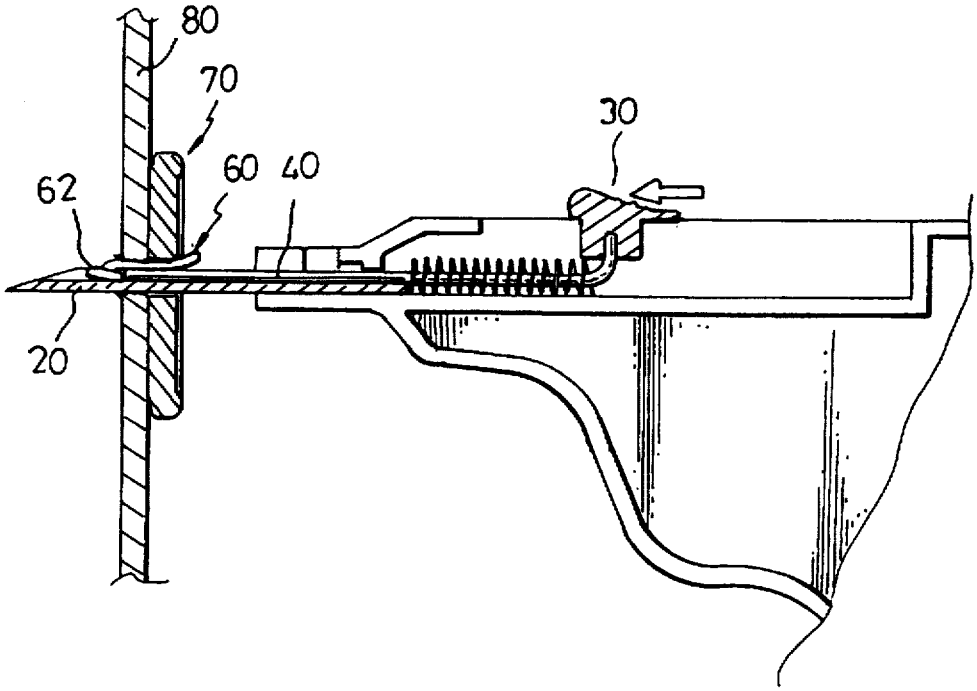

Referring to FIGS. 3 and 4, when the wire nail 60 is inserted into the wire nail feeding slot 16 with its legs 62 respectively forced into the longitudinal guide grooves 21 of the needles 20, the needles 20 are respectively inserted into the two through holes 71 of the button 70 and then through the cloth 80, then the push handle 30 is driven to push the projector rods 40 forwards, causing the legs 62 of the wire nail 60 to be forced through the cloth 80 to secure the button 70 to the cloth 80.

Because the user can hold the body with the palm and the other four fingers when the thumb is pressed on the push handle for driving the projector rods, the operation of the button attaching apparatus is convenient to operate. Furthermore, because no ejector mechanism is needed, the structure is simple.

While only one embodiment of the present invention has been shown and described, it will be understood that various modifications and changes could be made thereunto without departing from the spirit and scope of the invention disclosed.

What the invention claimed is:

1. A button attaching apparatus adapted for attaching a button to a cloth, comprising:

a body having a handhold portion, the handhold portion having a substantially circular configuration with flat opposite sides, and a barrel, said barrel having a longitudinal open top chamber;

a pair of needles fastened to said barrel and adapted for inserting through respective through holes in the button and piercing through the cloth, said needles each having a respective longitudinal guide groove;

a push handle slidably located on an exterior of said barrel so as to be slidable along said chamber; and, a pair of projector rods respectively connected to said push handle, and moved forward by said push handle in the longitudinal guide grooves of said needles.

2. The button attaching apparatus of claim 1 wherein the barrel of said body further comprises a wire nail mounting slot adapted for receiving a wire nail having two legs respectively engaging the longitudinal guide grooves of said needles.

3. The button attaching apparatus of claim 1 further comprising a pair of springs located in the body, a spring acting on each projector rod so as to impart a force on the associated projector rod.

4. The button attaching apparatus of claim 1 wherein the longitudinal open-top chamber extends in a direction generally tangential to the circular handhold portion.

5. The button attaching apparatus of claim 3 wherein each spring comprises a compression spring.

* * * * *